US007325436B2

(12) United States Patent
Cheng

(10) Patent No.: US 7,325,436 B2
(45) Date of Patent: Feb. 5, 2008

(54) EXPANDING TOOL FOR HOLLOW MEMBERS

(76) Inventor: Enzo Cheng, No. 2, Avenue 2, Lane 24, Sec. 2, Chongang Road, Taichung 40756 (TW)

( * ) Notice: Subject to any disclaimer, the term of this patent is extended or adjusted under 35 U.S.C. 154(b) by 42 days.

(21) Appl. No.: 11/444,208

(22) Filed: May 31, 2006

(65) Prior Publication Data

US 2007/0277581 A1 Dec. 6, 2007

(51) Int. Cl.
*B21D 41/02* (2006.01)
*B25B 7/12* (2006.01)
*B21J 9/18* (2006.01)

(52) U.S. Cl. ..... 72/393; 72/409.1; 72/452.1

(58) Field of Classification Search ..... 72/393, 72/370.06, 370.08, 409.09, 409.1, 409.17, 72/409.19, 452.1, 452.2, 452.4
See application file for complete search history.

(56) References Cited

U.S. PATENT DOCUMENTS 2,999,529 A 9/1961 Rast
4,034,591 A 7/1977 Rothenberger ..... 72/393
4,425,783 A * 1/1984 Rast ..... 72/393
4,890,472 A 1/1990 Rothenberger ..... 72/393
5,046,349 A 9/1991 Velte ..... 72/393
5,243,845 A * 9/1993 Velte ..... 72/393

* cited by examiner

*Primary Examiner*—Derris H. Banks
*Assistant Examiner*—Teresa M Bonk
(74) *Attorney, Agent, or Firm*—Charles E. Baxley

(57) ABSTRACT

An expanding tool includes a housing having a passage, an expanding device attached to the housing and having a number of expanding segments for engaging with and for expanding a pipe, an expanding mandrel is slidably engaged in the housing and includes a conically tapering end engageable into a conical bore of the expanding segments for moving the expanding segments to expand the pipe, an actuating lever includes an upper portion engageable into a groove of the expanding mandrel and pivotally attached to the housing with a shaft, the actuating lever includes two cam members for moving the expanding mandrel to expand the pipe, and for retracting the expanding mandrel from the housing.

10 Claims, 4 Drawing Sheets

EXPANDING TOOL FOR HOLLOW MEMBERS

BACKGROUND OF THE INVENTION

1. Field of the Invention

The present invention relates to an expanding tool, and more particularly to a pipe end expanding tool having a simplified configuration for effectively operating or actuating an expanding mandrel to expand the hollow members or hollow workpieces and to retract the expanding mandrel from the expanded hollow members or hollow workpieces.

2. Description of the Prior Art

Typical pipe end expanding tools comprise an expanding mandrel slidably received in a tool body, and a handle pivotally attached to the tool body and having a cam device for directly engaging with the expanding mandrel and for moving or forcing the expanding mandrel forwardly to engage with and to expand the hollow members or hollow workpieces.

Normally, the expanding mandrel will include a conically tapering end movable forwardly to engage with a number of expanding wedges or segments and to move the expanding wedges or segments radially and outwardly in order to expand the hollow members or hollow workpieces.

For example, U.S. Pat. No. 2,999,529 to Rast, and U.S. Pat. No. 4,034,591 to Rothenberger disclose two of the typical pipe end expanding tools each also comprising a handle pivotally attached to a tool body and having a cam device for directly engaging with an expanding mandrel that is slidably received in the tool body and for moving or forcing the expanding mandrel forwardly to engage with and to expand the hollow members or hollow workpieces.

However, the expanding mandrel may only be moved forwardly to engage with the expanding wedges or segments and to move the expanding wedges or segments radially and outwardly to expand the hollow members or hollow workpieces. After the conically tapering end of the expanding mandrel has been forced into the expanding wedges or segments, it will be difficult to retract and to remove the expanding mandrel from the expanding wedges or segments.

U.S. Pat. No. 4,890,472 to Rothenberger and U.S. Pat. No. 5,046,349 to Velte disclose the other typical pipe end expanding tools each also comprising an expanding mandrel slidably received in a tool body, and a handle pivotally attached to the tool body and having a cam device coupled to the expanding mandrel with a rigid tongue or linking member for indirectly engaging with the expanding mandrel and for moving or forcing the expanding mandrel forwardly to engage with and to expand hollow members or hollow workpieces.

The expanding mandrel may also be selectively moved rearwardly by the handle after the conically tapering end of the expanding mandrel has been forced into the expanding wedges or segments. However, the rigid tongue or linking member is normally made or formed into a plate-like structure which includes a greatly reduced thickness and which may have a good chance to be bent and damaged or distorted when the cam device of the handle moves or forces the expanding mandrel forwardly to engage with and to expand the hollow members or hollow workpieces.

The present invention has arisen to mitigate and/or obviate the afore-described disadvantages of the conventional pipe end expanding tools.

SUMMARY OF THE INVENTION

The primary objective of the present invention is to provide a pipe end expanding tool including a simplified configuration and including a stronger structure for effectively operating or actuating an expanding mandrel to expand hollow members or hollow workpieces and to retract the expanding mandrel from the expanded hollow members or hollow workpieces.

In accordance with one aspect of the invention, there is provided an expanding tool comprising a housing including a handle extended therefrom for being held by a user, and including a passage formed therein, and including a rear portion and a front portion, an expanding device attached to the front portion of the housing and including a number of expanding segments for engaging with a pipe to be expanded, and movable radially and outwardly and inwardly relative to the housing to expand the pipe, the expanding device including a conical bore formed in the expanding segments, an expanding mandrel slidably engaged in the passage of the housing, and including a conically tapering end movable and engageable into the conical bore of the expanding segments of the expanding device for moving the expanding segments radially and outwardly relative to the housing to expand the pipe, the expanding mandrel including a groove and an oblong hole formed therein and communicating with each other, and an actuating lever including an upper portion engageable into the groove of the expanding mandrel and pivotally attached to the housing with a shaft, the shaft being relatively and slidably received in the oblong hole of the expanding mandrel for allowing the expanding mandrel to be moved relative to the housing and the actuating lever, the actuating lever including a first cam member located in front of the shaft for moving and forcing the conically tapering end of the expanding mandrel to engage into the conical bore of the expanding segments of the expanding device and for moving the expanding segments radially and outwardly to engage with and to expand the pipe, and the actuating lever including a second cam member located behind the shaft for moving and retracting the conically tapering end of the expanding mandrel rearwardly relative to the housing.

The expanding mandrel includes a roller engaged into the groove of the expanding mandrel for engaging with the first cam member of the actuating lever. The expanding mandrel includes an axle engaged into the groove of the expanding mandrel for supporting the roller.

The expanding mandrel includes a rod engaged into the groove of the expanding mandrel for engaging with the second cam member of the actuating lever. The housing includes a channel formed in the rear portion of the housing and defined between two limbs, and the upper portion of the actuating lever is engageable into the channel of the housing.

The housing includes a cover attached to the front portion of the housing for supporting and attaching the expanding device to the front portion of the housing. The cover includes an aperture formed therein for movably receiving the expanding segments of the expanding device, and a number of slots formed in the cover and located around the aperture and communicating with the aperture of the cover.

The expanding segments of the expanding device each include a flange extended therefrom, and a pin attached to the flange and slidably engaged in the slots of the cover respectively for guiding the expanding segments to move relative to the cover. The pin includes two enlarged heads attached to two ends thereof for engaging with the cover and for limiting the pins and the expanding segments to move relative to the cover.

The housing includes an anvil provided thereon, and the actuating lever includes a projection extended therefrom for engaging with the anvil of the housing and for limiting the actuating lever to move relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 5:
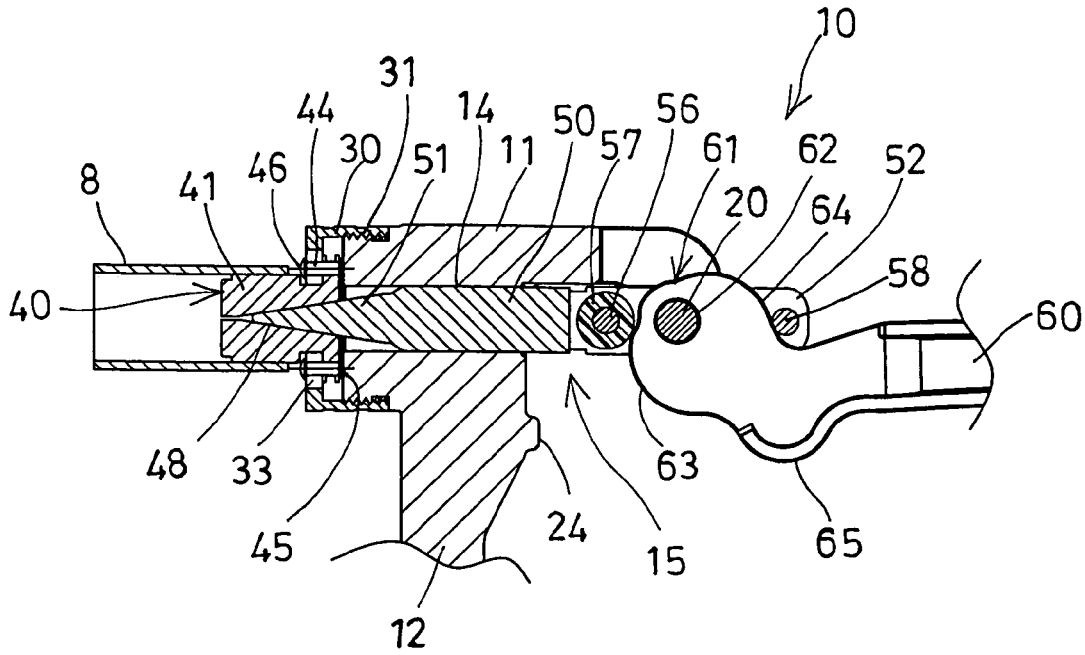
FIG. 5 is a partial cross sectional view of the pipe end expanding tool, taken along lines 5-5 of FIG. 4.
Figure 3:
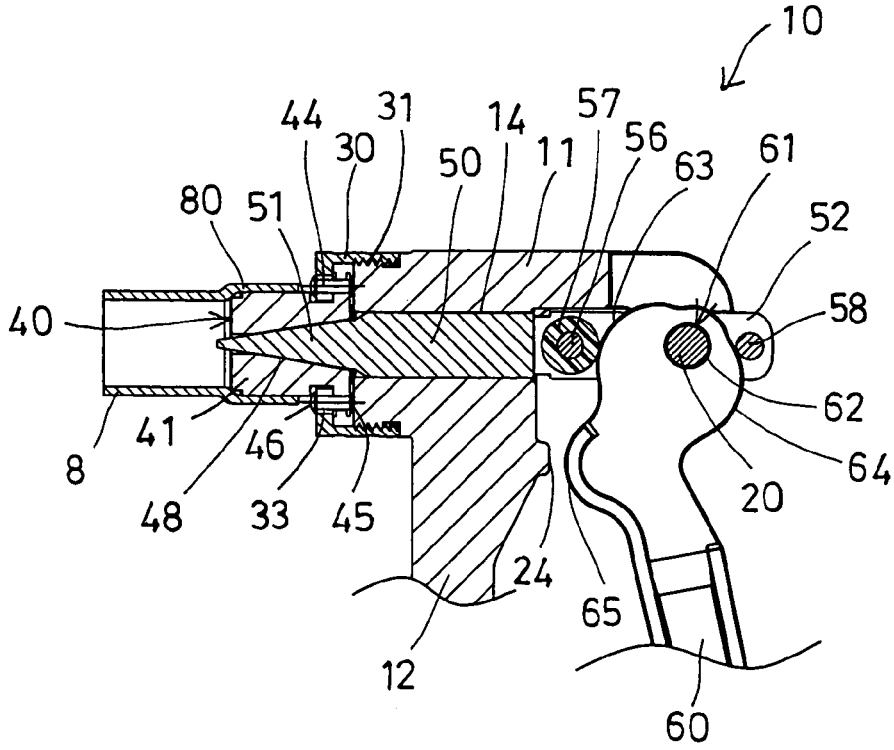
FIG. 3 is a partial cross sectional view of the pipe end expanding tool, taken along lines 3-3 of FIG. 2.
Figure 6:
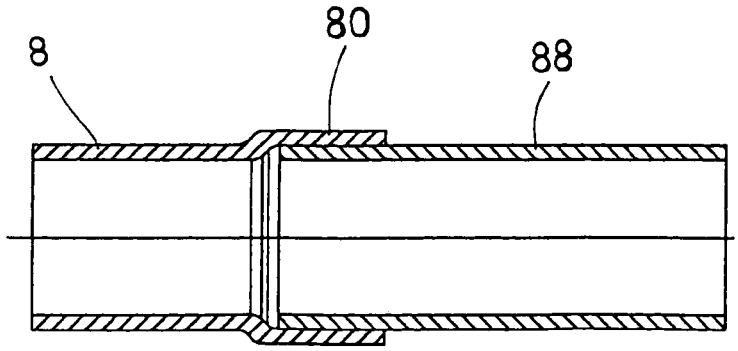
FIG. 6 is a partial cross sectional view illustrating the pipe or hollow member or hollow workpiece to be machined or expanded with the pipe end expanding tool.

Referring to the drawings, and initially to FIGS. 3 and 5-6, a pipe end expanding tool 10 in accordance with the present invention is designed and provided for expanding an end portion 80 of a pipe or hollow member or hollow workpiece 8 and for allowing the other pipe or hollow member or hollow workpiece 88 to be engaged into the expanded end portion 80 of the pipe 8.

Figure 1:
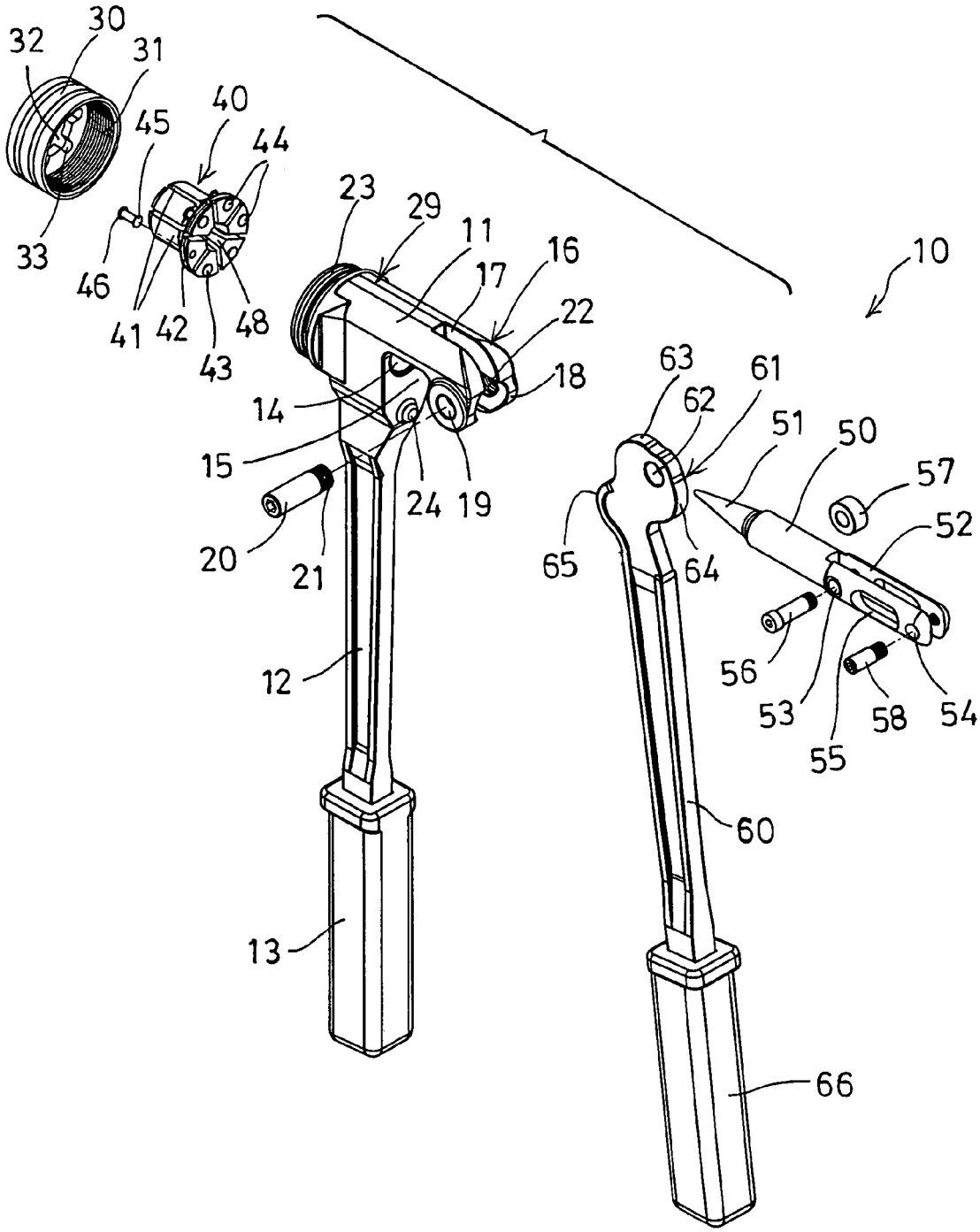
FIG. 1 is a partial exploded view of a pipe end expanding tool in accordance with the present invention.
Figure 2:
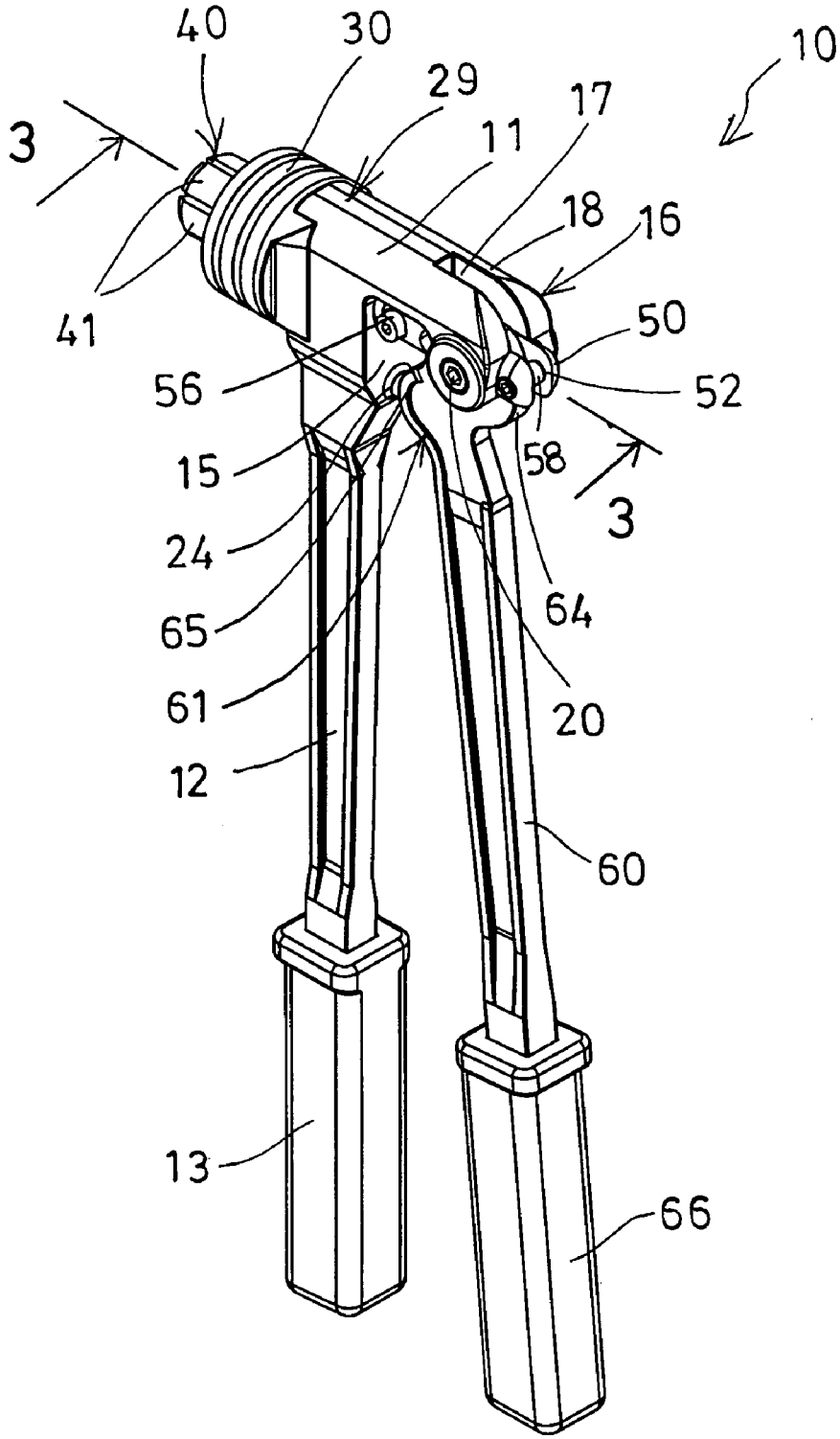
FIG. 2 is a perspective view of the pipe end expanding tool.

As shown in FIGS. 1-3, the pipe end expanding tool 10 comprises a tool body or housing 11, a handle 12 extended downwardly from the housing 11, and a soft or resilient hand grip 13 attached to the bottom portion of the handle 12 for being comfortably grasped or held by the users. The housing 11 includes a passage 14 longitudinally formed therein, and includes a notch 15 formed in the middle portion thereof for forming a rear portion or a rearwardly extended arm 16, and includes a channel 17 formed in the arm 16 and communicating with the passage 14 and the notch 15 of the housing 11, for forming or defining a pair of limbs 18.

The arm 16 includes an orifice 19 formed in one of the limbs 18 for slidably receiving a shaft 20 therein, and the shaft 20 includes an outer thread 21 formed on one end thereof for threading with an inner thread or a screw hole 22 that is formed in the other limb 18 of the arm 16, for detachably attaching or securing the shaft 20 to the rearwardly extended arm 16 of the housing 11. The housing 11 includes an outer thread 23 formed or provided on the front portion 29 thereof (FIG. 1) for threading and attaching a cover 30 thereto, and includes an anvil 24 provided thereon, such as located below the passage 14 of the housing 11.

For example, the cover 30 includes a screw hole or an inner thread 31 formed or provided therein for threading with the outer thread 23 of the housing 11 and thus for detachably attaching or securing the cover 30 to the front portion of the housing 11, and for receiving an expanding means or device 40 therein, and for allowing the expanding means or device 40 to be supported and attached to the front portion 29 of the housing 11 with the cover 30, the cover 30 includes an aperture 32 formed in the center portion thereof and a number of slots 33 formed therein (FIGS. 1, 3, 5) and located around the aperture 32 and communicating with the aperture 32 thereof.

The expanding device 40 includes two or more expanding wedges or segments 41 movably engaged in the aperture 32 of the cover 30 and movable radially and outwardly relative to the cover 30, the expanding segments 41 each include a flange 42 extended radially and outwardly for engaging with the cover 30 and for limiting the expanding segments 41 to move relative to the cover 30 and for preventing the expanding segments 41 from being disengaged from the cover 30, and each include a hole 43 formed in the flange 42 for slidably receiving a pin 44 therein, and the pin 44 includes two enlarged heads 45, 46 attached or provided on the ends thereof.

The pins 44 are slidably engaged in the slots 33 of the cover 30 and movable radially and outwardly and inwardly relative to the cover 30 for guiding the expanding segments 41 to move radially and outwardly and inwardly relative to the cover 30, and also for limiting the expanding segments 41 to move relative to the cover 30. The enlarged heads 45 of the pins 44 may be engaged with the flanges 42 of the expanding segments 41 for anchoring the pins 44 to the expanding segments 41, and the other enlarged heads 46 may be engaged with the cover 30 for anchoring and for limiting the pins 44 to move relative to the cover 30.

It is to be noted that the sliding engagement of the expanding segments 41 in the cover 30 is typical, but the typical pipe end expanding tools failed to provide a number of slots 33 formed in the cover 30 and located around the aperture 32 of the cover 30 and communicating with the aperture 32 of the cover 30, for allowing the pins 44 of the expanding segments 41 to be easily and quickly engaged into the slots 33 of the cover 30. The expanding means or device 40 includes a typical conical bore 48 formed therein, such as formed in the expanding segments 41 for allowing the expanding segments 41 to be expanded or to be moved radially and outwardly and inwardly relative to the cover 30.

An expanding mandrel 50 is slidably received and engaged in the passage 14 of the housing 11, and includes a conically tapering end 51 movable or engageable into the conical bore 48 of the expanding segments 41 of the expanding device 40 for moving the expanding segments 41 radially and outwardly relative to the cover 30 in order to expand the hollow members or hollow workpieces or pipes 8. In operation, the expanding segments 41 may be engaged into the end portion 80 of the pipe 8 (FIG. 5) and may be moved radially and outwardly to force the expanding segments 41 to move and to expand the end portion 80 of the hollow members or hollow workpieces or pipes 8, best shown in FIG. 3.

The expanding mandrel 50 includes a groove 52 formed in the rear portion thereof, an orifice 53 and an aperture 54 also formed in the rear portion thereof (FIG. 1) and communicating with the groove 52 thereof, and an oblong hole 55 also formed in the rear portion thereof and also communicating with the groove 52 thereof and located between the orifice 53 and the aperture 54 thereof for slidably receiving the shaft 20 therein and for guiding and for limiting the expanding mandrel 50 to move relative to the housing 11. An axle 56 is engaged into the orifice 53 of the expanding mandrel 50 and secured to the expanding mandrel 50, and a wheel or roller 57 is rotatably engaged onto the axle 56 and received in the groove 52 of the expanding mandrel 50. A rod 58 is engaged into the aperture 54 of the expanding mandrel 50 and secured to the expanding mandrel 50.

An actuating lever 60 includes an upper portion 61 engageable into the groove 52 of the expanding mandrel 50 (FIGS. 3, 5) and also slidably engaged into the channel 17 of the arm 16, and includes a hole 62 formed in the upper portion 61 thereof for receiving the shaft 20 and thus for pivotally attaching or coupling the upper portion 61 of the actuating lever 60 to the housing 11. The actuating lever 60 further includes two cam members 63, 64 formed or provided on the upper portion 61 thereof and located in front of and behind the shaft 20 and the hole 62 of the actuating lever 60 respectively for engaging with the roller 57 and the rod 58 respectively, and for moving or forcing the expanding mandrel 50 forwardly to engage with and to expand the pipe 8 (FIG. 3) and for retracting the expanding mandrel 50 rearwardly relative to the housing 11 (FIG. 5).

Figure 4:
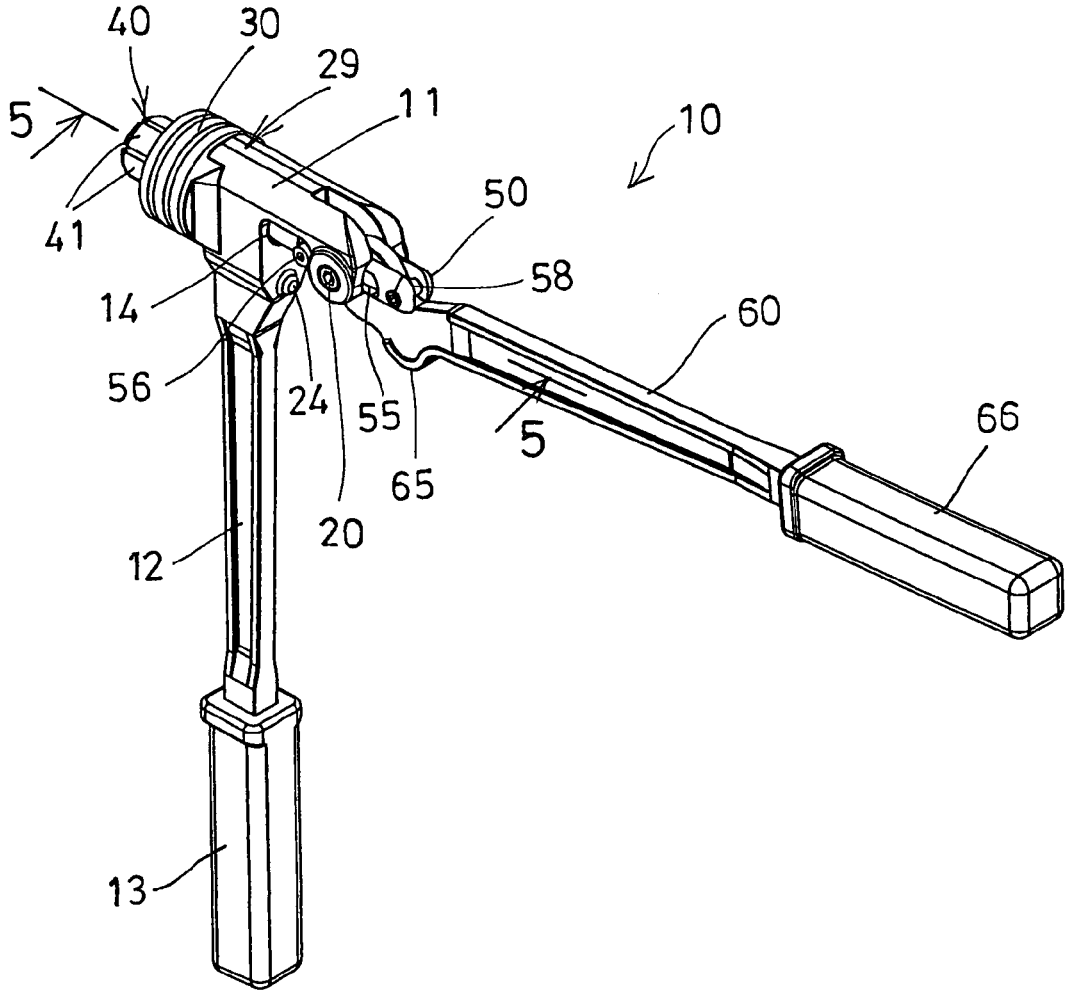
FIG. 4 is another perspective view similar to FIG. 2, illustrating the operation of the pipe end expanding tool.

In operation, as shown in FIGS. 4 and 5, the expanding mandrel 50 may first be retracted rearwardly relative to the housing 11 to move the conically tapering end 51 of the expanding mandrel 50 rearwardly relative to the housing 11 and away from the expanding segments 41 of the expanding device 40, by rotating the actuating lever 60 away from the handle 12 toward a horizontal position substantially parallel to the housing 11 and perpendicular to the handle 12. The cam member 64 which is located behind the shaft 20 and the hole 62 of the actuating lever 60 may be engaged with the rod 58 for moving or for retracting the expanding mandrel 50 rearwardly relative to the housing 11.

When the conically tapering end 51 of the expanding mandrel 50 is moved rearwardly relative to the expanding segments 41 of the expanding device 40, the expanding segments 41 will not be moved radially and outwardly such that the hollow member or hollow workpiece or pipe 8 may be easily engaged onto the expanding segments 41. The expanding segments 41 may then be moved radially and outwardly to expand the pipe 8 when the conically tapering end 51 of the expanding mandrel 50 is moved or engaged into the conical bore 48 of the expanding segments 41 of the expanding device 40, as shown in FIGS. 2 and 3, by rotating the actuating lever 60 toward the handle 12.

The cam member 63 which is located in front of the shaft 20 and the hole 62 of the actuating lever 60 may be engaged with the roller 57 for moving or forcing the expanding mandrel 50 forwardly to engage with and to expand the pipe 8. The actuating lever 60 may further include a pad or projection 65 extended therefrom for engaging with the anvil 24 of the housing 11, and for limiting the actuating lever 60 to move relative to the handle 12 and the housing 11, and thus for limiting the expanding mandrel 50 to move relative to the expanding segments 41 and for preventing the expanding segments 41 from being over-expanded by the expanding mandrel 50. The actuating lever 60 may further include a soft or resilient hand grip 66 attached to the bottom portion of the actuating lever 60 for being comfortably grasped or held by the users.

It is to be noted that the axle 56 and/or the roller 57 and/or the rod 58 may also be formed integral with the expanding mandrel 50, and the upper portion 61 of the actuating lever 60 may also be engaged into the groove 52 of the expanding mandrel 50, for allowing the cam members 63, 64 of the actuating lever 60 to be directly engaged with the expanding mandrel 50, in order to move or force the expanding mandrel 50 forwardly to engage with and to expand the pipe 8 and to move or retract the expanding mandrel 50 rearwardly relative to the housing 11 respectively.

The typical pipe end expanding tools failed to provide an actuating lever 60 having an upper portion 61 engaged into the groove 52 of the expanding mandrel 50 and having a front cam member 63 and a rear cam member 64 for engaging with the expanding mandrel 50 or for engaging with the roller 57 and the rod 58 that are attached to the expanding mandrel 50. The shaft 20 is relatively and slidably received in the oblong hole 55 of the expanding mandrel 50 for allowing the expanding mandrel 50 to be moved relative to the housing 11 by the actuating lever 60.

Accordingly, the pipe end expanding tool in accordance with the present invention includes a simplified configuration or structure for effectively operating or actuating an expanding mandrel to expand hollow members or hollow workpieces and to retract the expanding mandrel from the expanded hollow members or hollow workpieces.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An expanding tool comprising:

a housing including a handle extended therefrom for being held by a user, and including a passage formed therein, and including a rear portion and a front portion, an expanding device attached to said front portion of said housing and including a plurality of expanding segments for engaging with a pipe to be expanded, and movable radially and outwardly and inwardly relative to said housing to expand the pipe, said expanding device including a conical bore formed in said expanding segments, an expanding mandrel slidably engaged in said passage of said housing, and including a conically tapering end movable and engageable into said conical bore of said expanding segments of said expanding device for moving said expanding segments radially and outwardly relative to said housing to expand the pipe, said expanding mandrel including a groove and an oblong hole formed therein and communicating with each other, and an actuating lever including an upper portion engageable into said groove of said expanding mandrel and pivotally attached to said housing with a shaft, said shaft being relatively and slidably received in said oblong hole of said expanding mandrel for allowing said expanding mandrel to be moved relative to said housing and said actuating lever, said actuating lever including a first cam member located in front of said shaft for moving and forcing said conically tapering end of said expanding mandrel to engage into said conical bore of said expanding segments of said expanding device and for moving said expanding segments radially and outwardly to engage with and to expand the pipe, and said actuating lever including a second cam member located behind said shaft for moving and retracting said conically tapering end of said expanding mandrel rearwardly relative to said housing.

2. The expanding tool as claimed in claim 1, wherein said expanding mandrel includes a roller engaged into said groove of said expanding mandrel for engaging with said first cam member of said actuating lever.

3. The expanding tool as claimed in claim 2, wherein said expanding mandrel includes an axle engaged into said groove of said expanding mandrel for supporting said roller.

4. The expanding tool as claimed in claim 1, wherein said expanding mandrel includes a rod engaged into said groove of said expanding mandrel for engaging with said second cam member of said actuating lever.

5. The expanding tool as claimed in claim 1, wherein said housing includes a channel formed in said rear portion of said housing and defined between two limbs, and said upper portion of said actuating lever is engageable into said channel of said housing.

6. The expanding tool as claimed in claim 1, wherein said housing includes a cover attached to said front portion of said housing for supporting and attaching said expanding device to said front portion of said housing.

7. The expanding tool as claimed in claim 6, wherein said cover includes an aperture formed therein for movably receiving said expanding segments of said expanding device, and a plurality of slots formed in said cover and located around said aperture and communicating with said aperture of said cover.

8. The expanding tool as claimed in claim 7, wherein said expanding segments of said expanding device each include a flange extended therefrom, and a pin attached to said flange and slidably engaged in said slots of said cover respectively for guiding said expanding segments to move relative to said cover.

9. The expanding tool as claimed in claim 8, wherein said pin includes two enlarged heads attached to two ends thereof for engaging with said cover and for limiting said pins and said expanding segments to move relative to said cover.

10. The expanding tool as claimed in claim 1, wherein said housing includes an anvil provided thereon, and said actuating lever includes a projection extended therefrom for engaging with said anvil of said housing and for limiting said actuating lever to move relative to said housing.

* * * * *